US007283060B2

(12) United States Patent
Robison et al.

(10) Patent No.: US 7,283,060 B2
(45) Date of Patent: Oct. 16, 2007

(54) CONTROL APPARATUS FOR AUTOMATED DOWNHOLE TOOLS

(75) Inventors: Clark Robison, Tomball, TX (US); Scott Weatherill, Humble, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 357 days.

(21) Appl. No.: 10/763,577

(22) Filed: Jan. 22, 2004

(65) Prior Publication Data

US 2004/0183692 A1 Sep. 23, 2004

Related U.S. Application Data

(60) Provisional application No. 60/441,884, filed on Jan. 22, 2003.

(51) Int. Cl.
*G01V 3/00* (2006.01)

(52) U.S. Cl. ..... 340/853.1; 340/853.2; 340/853.4; 340/854.8; 340/856.3; 367/81; 367/85

(58) Field of Classification Search ..... 367/81, 367/25; 702/7, 9, 16; 703/5, 10; 175/19, 175/45, 57

See application file for complete search history.

(56) References Cited

U.S. PATENT DOCUMENTS

| | | | | |
|---|---|---|---|---|
| 4,636,934 A | | 1/1987 | Schwendemann et al. | |
| 5,831,156 A | | 11/1998 | Mullins | |
| 5,890,540 A | * | 4/1999 | Pia et al. | 166/321 |
| 6,023,443 A | * | 2/2000 | Dubinsky et al. | 367/76 |
| 6,041,860 A | * | 3/2000 | Nazzal et al. | 166/250.01 |
| 6,048,175 A | * | 4/2000 | Corlew et al. | 417/120 |
| 6,109,357 A | * | 8/2000 | Zimmerman | 166/387 |
| 6,233,524 B1 | * | 5/2001 | Harrell et al. | 702/9 |
| 6,368,068 B1 | * | 4/2002 | Corlew et al. | 417/120 |
| 6,431,270 B1 | * | 8/2002 | Angle | 166/66.5 |
| 6,944,547 B2 | * | 9/2005 | Womer et al. | 702/7 |
| 2002/0018399 A1 | | 2/2002 | Schultz et al. | |
| 2002/0120401 A1 | * | 8/2002 | Macdonald et al. | 702/6 |
| 2003/0063073 A1 | * | 4/2003 | Geaghan et al. | 345/173 |

FOREIGN PATENT DOCUMENTS

| | | |
|---|---|---|
| GB | 2 325 949 | 12/1998 |
| GB | 2 330 598 | 4/1999 |
| GB | 2 334 284 | 8/1999 |
| GB | 2 353 055 | 2/2001 |
| GB | 2 371 577 | 7/2002 |
| WO | WO99/15756 | 4/1999 |

OTHER PUBLICATIONS

U.K. Search Report, Application No. GB 0401312.4, dated Mar. 11, 2004.

U.K. Search Report, Application No. GB 0401312.4, dated Jun. 29, 2004.

French Search Report, Application No. 0400623000, dated Aug. 3, 2005.

* cited by examiner

*Primary Examiner*—Jeffery Hofsass
*Assistant Examiner*—Sisay Yacob
(74) *Attorney, Agent, or Firm*—Patterson & Sheridan, LLP

(57) ABSTRACT

A method and apparatus for a computer controlled apparatus for use in wellbore completions. A touch-screen is provided that facilitates commands and information that is entered by an operator ordering movement of a downhole tool. In another embodiment, real-time information about the status of the downhole tools is transmitted to the apparatus based upon operating variables within the system, like pressure, flow rate, total flow, and time.

13 Claims, 12 Drawing Sheets

CONTROL APPARATUS FOR AUTOMATED DOWNHOLE TOOLS

CROSS-REFERENCE TO RELATED APPLICATIONS

This application claims benefit of U.S. Provisional Patent Application Ser. No. 60/441,884, filed Jan. 22, 2003, which application is herein incorporated by reference in its entirety.

BACKGROUND OF THE INVENTION

1. Field of the Invention

The present invention relates to automated downhole tools that are remotely movable between a primary and a secondary position. Particularly, the invention relates to computer control of automated downhole tools using an interactive computer touch-screen to facilitate use of a control system that operates the tools. More particularly, the invention relates to a means of monitoring the operation of the downhole tools using computer software to compare variables to known standards.

2. Description of the Related Art

In oil and gas wells, hydrocarbons are collected from at least one wellbore formed in the earth by drilling. In some cases, the wellbore is lined with steel pipe called casing or liner that is perforated at a given location to permit the inflow of hydrocarbons. In other instances, the wellbores are left unlined or "open" to facilitate the collection of hydrocarbons along a relatively long length of the wellbore. When hydrocarbons are collected at different locations within the well, it is useful to control the inflow of the fluid between the different points along the wellbore in order to take advantage of changing wellbore conditions. For example, inflow devices with adjustable sleeves can be placed at different, isolated locations in a tubular string. The sleeves in these devices have apertures formed therethrough that can be placed in or out of alignment with mating apertures in the body of the tool. By adjusting the relative position of the apertures, the sleeves can permit a varying amount of fluid to pass into a production stream for collection at the surface. The ability to control inflow is especially important along a wellbore where the make up of the incoming fluid can change over time. For example, if an unacceptable amount of water begins flowing into production tubing at a certain location, an inflow device at that location can be partially or completely closed, thereby preventing the water from entering the production stream.

Some prior art inflow devices require the sleeves to be set at the surface of the well based upon a prediction about the wellbore conditions. After run-in, changing the position of the devices requires them to be completely removed from the well along with the string of tubulars upon which they are installed. More recently, the inflow devices have been made to operate remotely using hydraulic fluid transported in a control line or some electrical means to shift them between positions. In the most advanced applications known as "Intelligent Completions", the devices are computer controlled, permitting them to be operated according to a computer program.

A typical computer-controlled apparatus for the operation of downhole inflow devices includes a keyboard that is connected to a computer; solenoid-controlled valves that open to permit control fluid to travel down to the device in the wellbore; a pump; a source of control fluid; and at least two fluid lines traveling downhole to a fluid powered controller that determines which of the more than one hydraulic/mechanical inflow device is supplied with the control fluid. Typically, the controller includes some type of keyable member that can align or misalign fluid ports connected to the devices therebelow. Each such device has at least one fluid line extending from the fluid controller, but may require a multiplicity of fluid lines. The fluid lines provide fluid to the device and a path for return fluid back to the surface. In one arrangement, the computer at the surface provides a source of fluid at a relatively low pressure that can shift an internal valve mechanism in the controller in order to set up a particular alignment of ports to supply control fluid to the proper downhole device. Once the fluid controller is properly arranged, control fluid is provided at a second, higher pressure to the particular device in order to move a shiftable sleeve from its initial position to a second position. In this manner, each device can be operated and separate control lines for each device need not extend back to the surface.

While the computers have made the devices much more useful in wells, there are some realities with computer equipment at well locations that make their use difficult and prone to error. For example, personnel at a well are not typically trained to operate computer keyboards and even the most straightforward commands must be entered with the keyboard, posing opportunities for error. Even the use of a computer mouse requires precise movements that are difficult in a drilling or production environment. Additionally, environmental conditions at a well include heat, dirt, and grime that can foul computer equipment like a keyboard and shorten its life in a location where replacement parts and computer technicians are scarce.

Another issue related to computer-controlled equipment is confirming that the orders given to a downhole device via computer have actually been carried out. For example, in computer-controlled systems, a command is given for a downhole tool to move from one position to another. Ultimately, the software command is transmitted into some mechanical movement within the tool. While there might be a computer-generated confirmation that the command has been given, there is no real way of immediately knowing that the prescribed physical action has taken place. In some instances, movement within a tool is confirmed by monitoring the well production to determine if the flow has been affected by the closing of an inflow device. This type of confirmation however, is time consuming and uncertain.

There is a need therefore for a computer control system that is easier to use when operating automated downhole tools in a wellbore. There is a further need for an apparatus and method of quickly and easily ensuring the automated computer commands to downhole equipment have been carried out.

SUMMARY OF THE INVENTION

The present invention generally includes a computer-controlled apparatus for use in wellbore completions. A touch-screen is provided that facilitates commands and information that is entered by an operator ordering movement of a downhole tool. In another embodiment, real-time information about the status of the downhole tools is transmitted to the apparatus based upon operating variables within the system, like pressure, flow rate, total flow, and time.

In another aspect, the present invention provides a method of operating one or more downhole devices in a wellbore. The method includes disposing the one or more devices in the wellbore, the one or more devices having at least an open and a closed position. Also, a signal is provided to the one or more devices to move the one or more devices between the open and the closed position. Preferably, the signal is computer generated based upon an operator's interaction with a touch screen.

In another aspect, the present invention provides a method of monitoring operation of a downhole tool. The method includes providing a signal to the downhole tool, whereby the signal causes the tool to move between an initial and a second position. Additionally, the method includes monitoring variables within a fluid power system to confirm the position of the downhole tool, the variables including at least one of pressure, time, total flow, or flow rate.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1A:
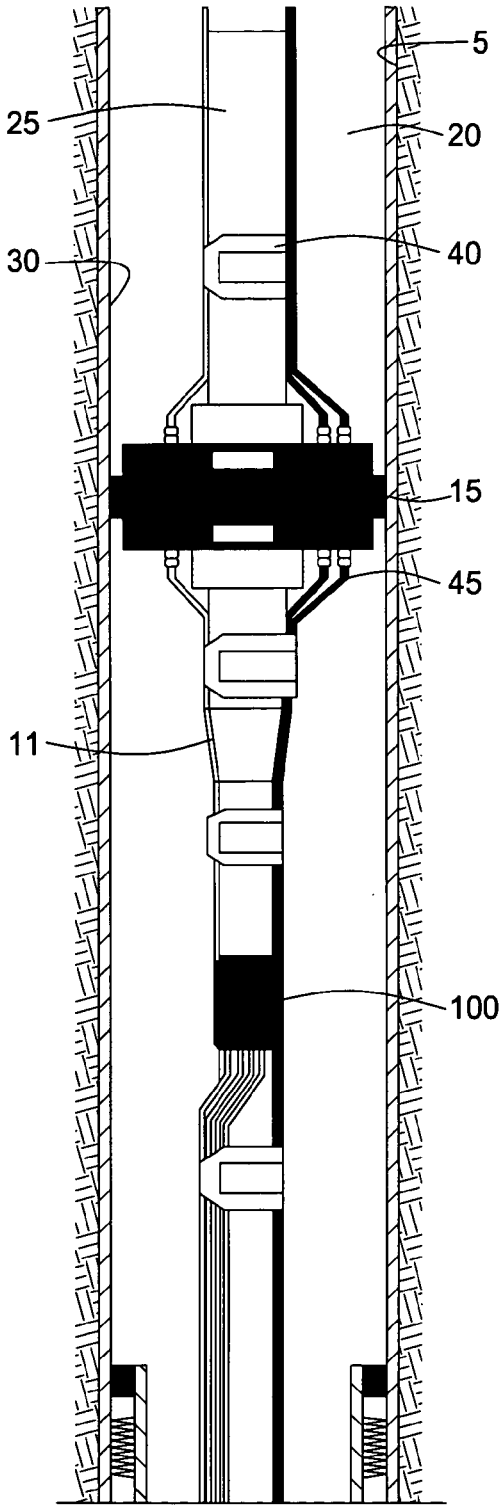
FIG. 1 is a section view of a wellbore showing some components making up an intelligent completion apparatus.
Figure 1B:
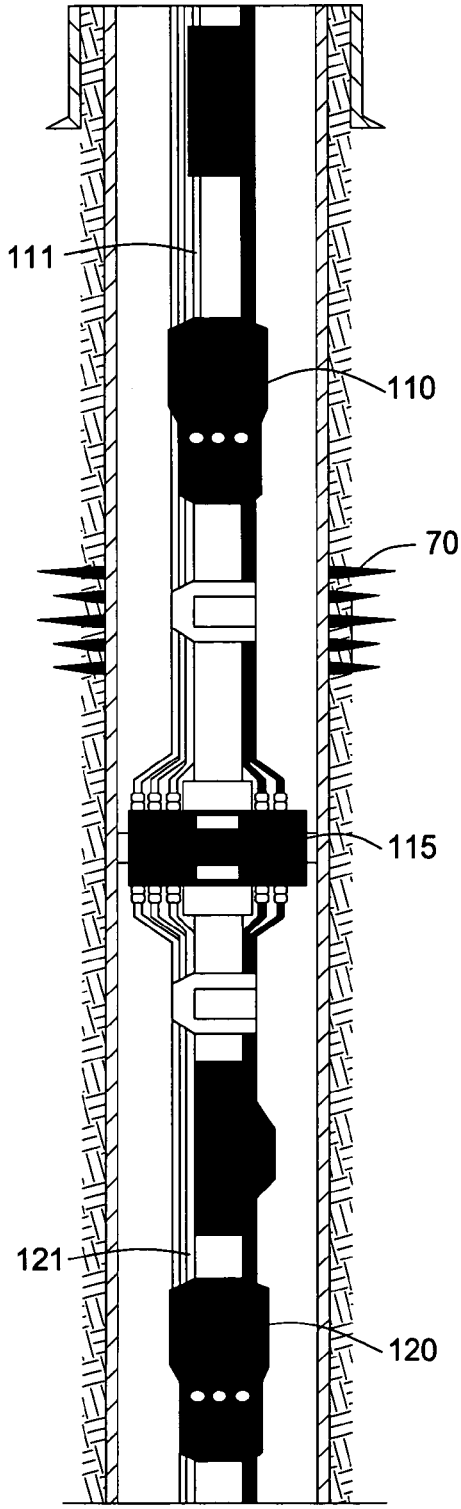
Figure 1C:
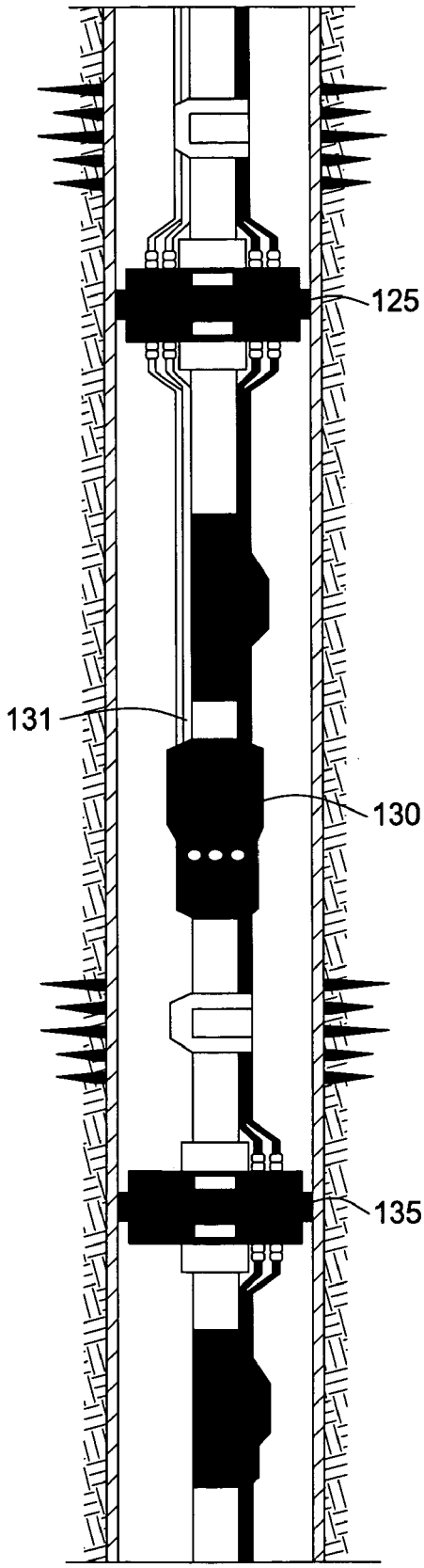
Figure 1D:
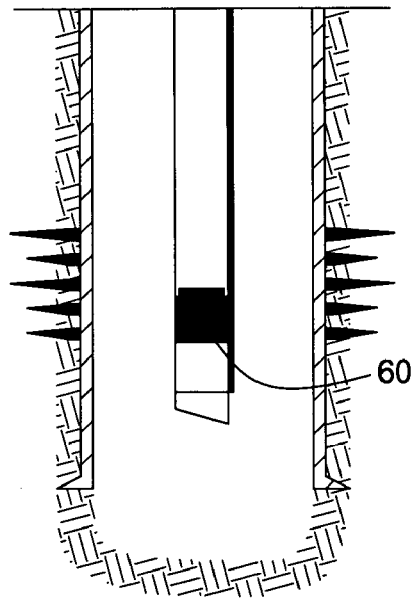

The present invention relates to automated downhole equipment and its control using a touch-screen at the surface of the well to input commands and information. The invention further relates to a quick, simple and reliable means to ensure that computer generated commands to operate downhole tools are successfully carried out.

FIGS. 2-7 referred to in this application illustrate a touch-screen. A basic touch-screen system is made up of three components: a touch sensor, controller, and software driver. The sensor is a clear panel, which when touched, registers a voltage change that is sent to the controller. The controller processes this signal and passes the touch event data to the PC through a bus interface, be it a bus-card, serial, USB, infrared, or wireless. The software driver takes this data and translates the touch events into mouse events.

Resistive LCD touch screen monitors, such as the ones intended by the inventors, rely on a touch overlay, which is composed of a flexible top layer and a rigid bottom layer separated by insulating dots, attached to a touch-screen controller. The inside surface of each of the two layers is coated with a transparent metal oxide coating (ITO) that facilitates a gradient across each layer when voltage is applied. Pressing the flexible top sheet creates electrical contact between the resistive layers, producing a switch closing in the circuit. The control electronics alternate voltage between the layers and pass the resulting X and Y touch coordinates to the touch-screen controller. The touch-screen controller data is then passed on to the computer operating system for processing.

Resistive touch-screen technology possesses many advantages over other alternative touch-screen technologies (acoustic wave, capacitive, Near Field Imaging, infrared). Highly durable, resistive touch-screens are less susceptible to contaminants that easily infect acoustic wave touch-screens. In addition, resistive touch-screens are less sensitive to the effects of severe scratches that would incapacitate capacitive touch-screens. For industrial applications like well production, resistive touch-screens are more cost-effective solutions than near field imaging touch-screens. Because of its versatility and cost-effectiveness, resistive touch-screen technology is the touch technology of choice for many markets and applications.

FIG. 1 is a partial section view of a wellbore 5 showing the components that might be typically used with the present invention. The components (described from the upper wellbore to the lower end thereof) include hydraulic control lines 11 that carry fluid to and from components. A production packer 15 seals an annular area 20 between production tubing 25 and the wall of casing 30 therearound. Below the production packer 15 is the downhole controller 100 referred to as a "hydraulically controlled addressing unit" that is used to control one of various downhole, inflow devices 110, 120, 130. Below the controller 100 and above a zonal isolation packer 115, is an inflow device 110 referred to in FIG. 1 as a remotely operated sliding sleeve (ROSS). The sleeve 110 is of the type described herein with a sliding member that determines the inflow of fluid into the production tubing 25. In this embodiment, two additional inflow devices 120, 130 are disposed in the wellbore 5. Each of the sleeves 110, 120, 130 is located in its own isolated section of the wellbore 5, and each includes a set of sleeve control cables 111, 121, 131 extending back upwards to the controller 100. Casing perforations 70 are shown that form a fluid path from the formation around the wellbore 5 into the inflow devices 110, 120, 130. It is understood that the inflow devices 110, 120, 130 may also be operated to regulate the outflow of fluids from the production tubing 25.

In the preferred embodiment, the controller 100 is adapted to control all of the inflow devices 110, 120, 130. As shown, the controller 100 is designed to control all three inflow devices. Particularly, information or instructions from the touch screen may initially be transmitted to the controller 100. In turn, the information or instruction causes an actuating member in the controller 100 to move relative to a park position. As will be discussed below, the actuating member will position itself such that the control lines 11 will align with the sleeve control lines of the selected inflow sleeve 110, 120, 130 for operation thereof. According to aspects of the present invention, the control cables 111, 121, 131 of the inflow devices 110, 120, 130 need only connect to the controller 100, which is also located in the wellbore 5. In this respect, it is not necessary to run control lines for each inflow device all the way to the surface, thereby reducing the number of control lines to the surface. In addition to hydraulic control lines, the inventors also contemplate using electric lines, fiber optics, cable, wireless, mechanical or other means known to a person of ordinary skill in the art to communicate or transmit information or instruction between the touch screen, controller 100, and the inflow devices 110, 120, 130. For example, after election is made on the touch screen, a fiber optics signal may be transmitted to the controller 100 via a fiber optics cable.

Figure 2:
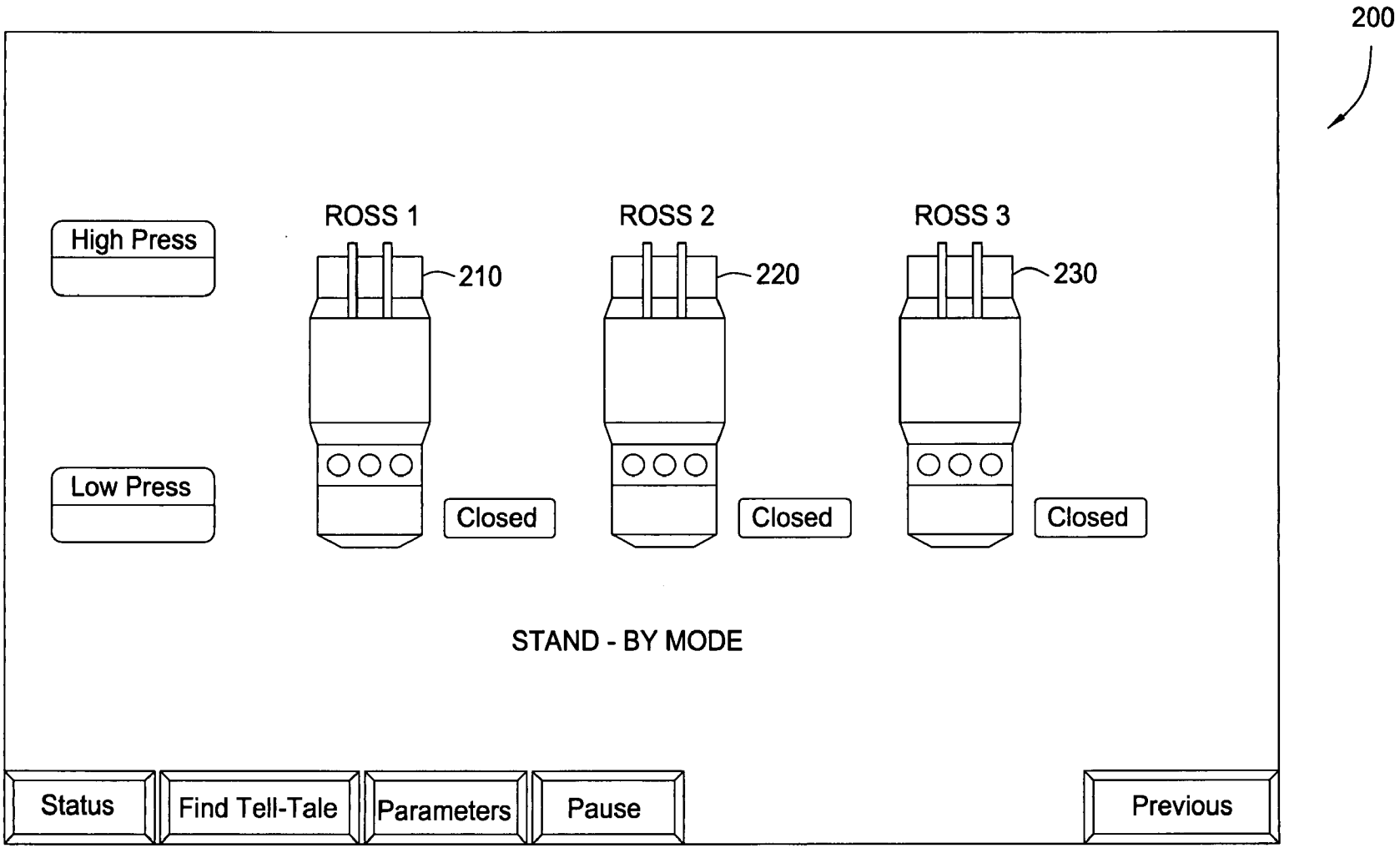
FIGS. 2-7 are touch screens representing various steps in the operation of the control apparatus of the present invention.

FIG. 2 shows the touch-screen 200 that is located at the surface of the well and is used to control the position of the inflow devices 110, 120, 130 as well as to monitor operating characteristics and input information. As shown in FIG. 2, the touch-screen 200 includes an icon 210, 220, 230 representing each downhole device 110, 120, 130 that is controlled from the surface. In the example of FIG. 2, there are three downhole inflow devices, each having an adjustable sliding sleeve that is manipulatable from the surface of the well via commands given at the touch-screen 200. The devices 110, 120, 130 are labeled "ROSS 1," "ROSS 2," and "ROSS 3," respectively. In FIG. 2, the touch screen system is in "stand-by mode" waiting for instructions. Additionally, the status of the inflow devices is "closed."

In operation, an operator may initially touch a decision screen, e.g., FIG. 2, to indicate a desire to operate the inflow devices. For example, the operator may touch the icon 210 for the first device ("ROSS 1") 110 to indicate a desire to send a command to the first device 110. In another embodiment, the screen 200 could be operated through a wireless remote device utilizing an infrared light source or any other means well known in the art to send commands to a receiver located at a computer.

Figure 3:
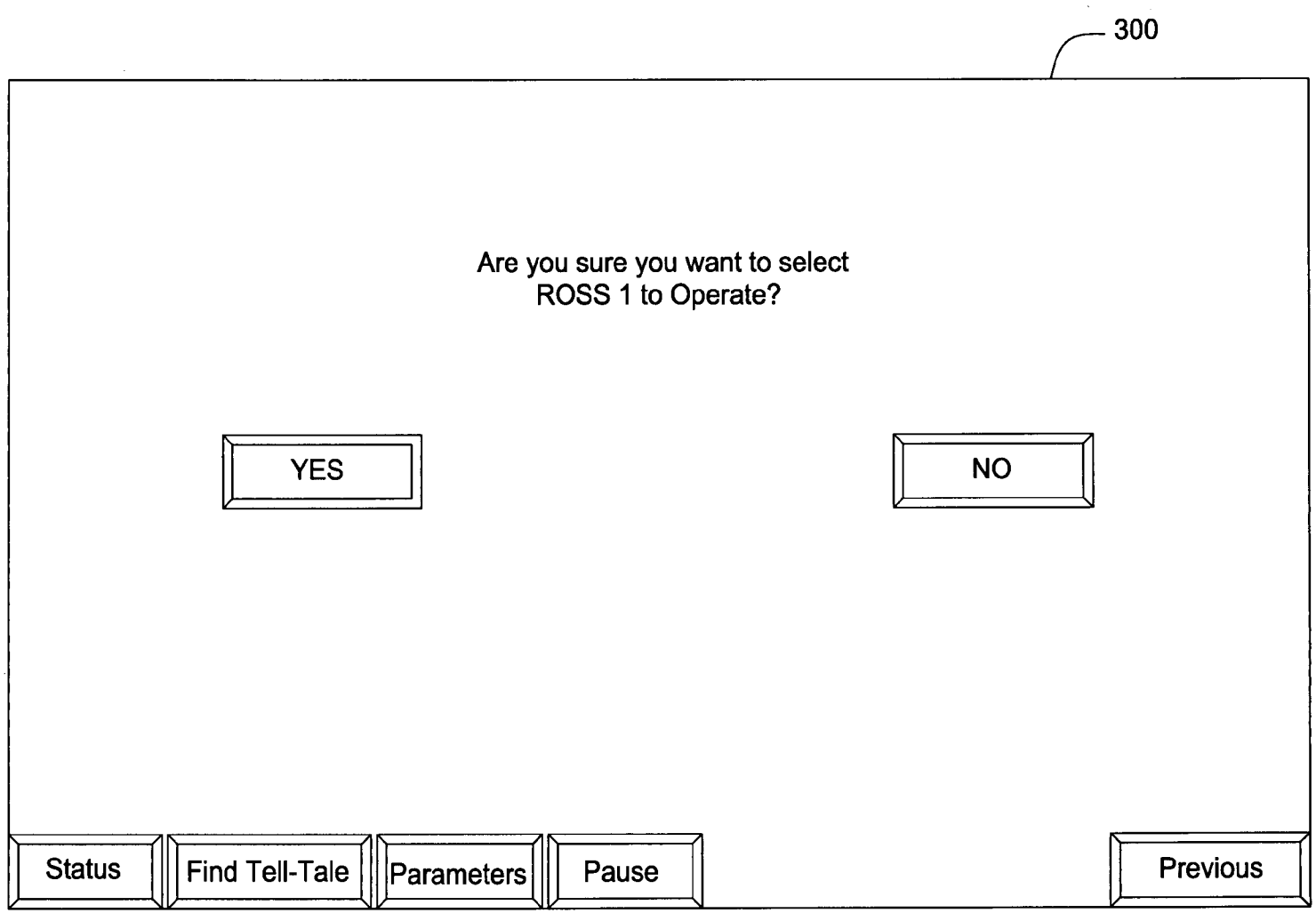

After the initial selection, another screen 300, shown in FIG. 3, prompts the operator to confirm his decision to operate the first inflow device 110. To confirm, the operator may touch the screen 300 where indicated.

Figure 4:
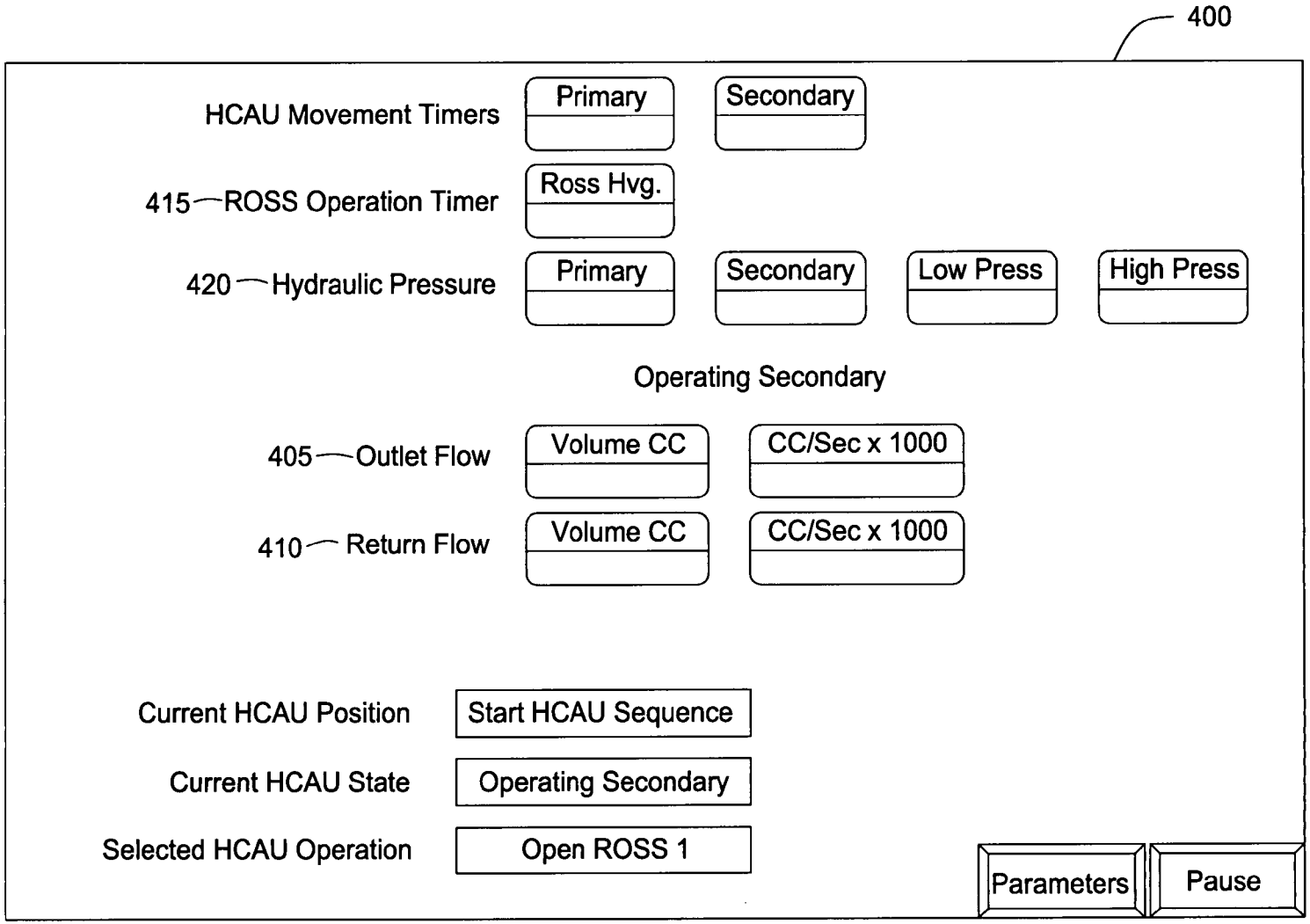
Figure 5:
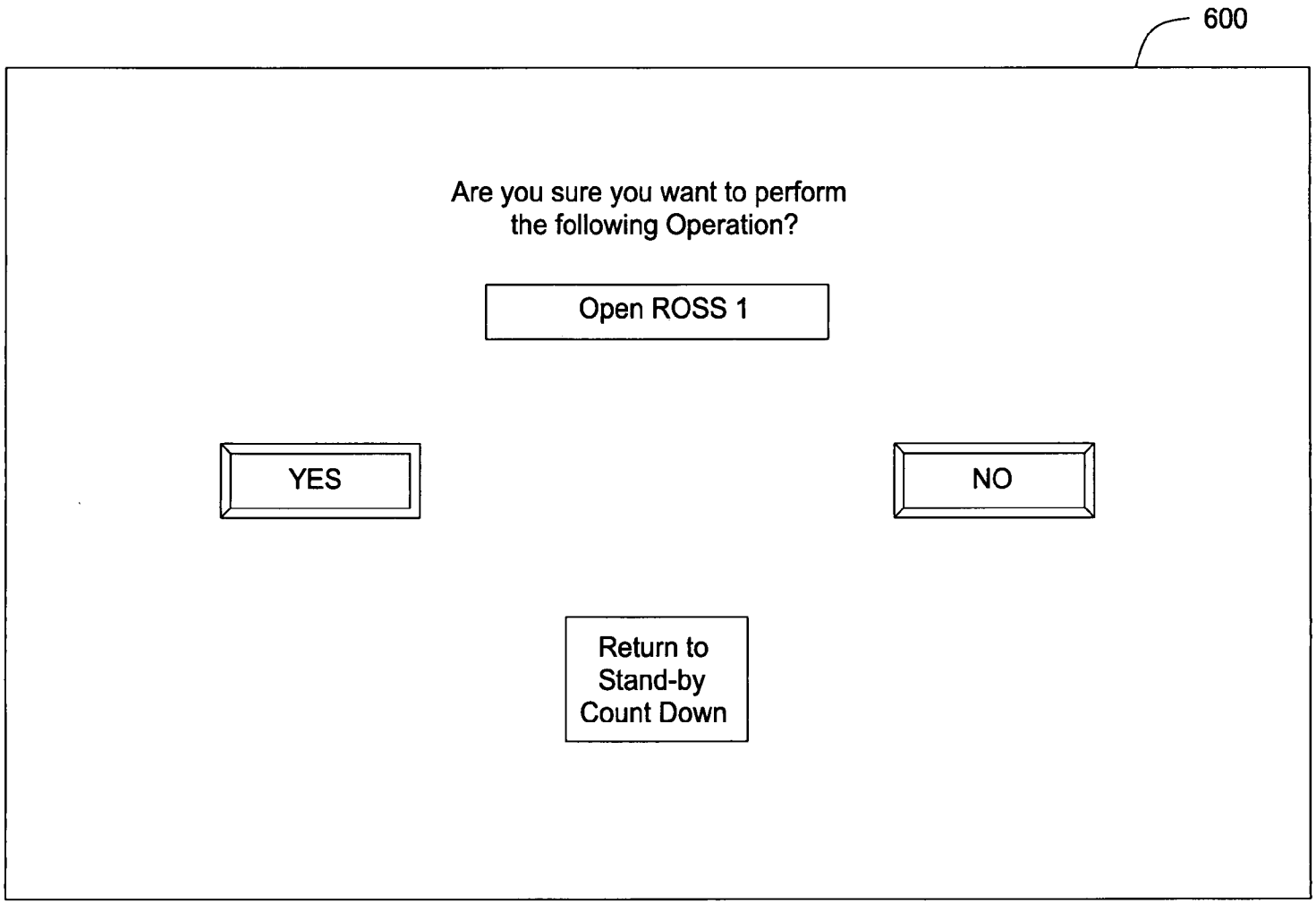

After a response is received, the touch screen 400, as shown in FIG. 4, will illustrate the corresponding operation of the fluid controller 100 to align the control lines 11 to the sleeve control lines 111 of the first inflow device 110. In this respect, a pump at the surface provides a first, low pressure to rotate the actuating member of the controller 110. In this manner, the actuating member is rotated to align the control line 11 with the sleeve control lines 111, thereby placing the fluid ports of the pump in fluid communication with the inflow device 110. As indicated on the screen 400, the "Selected HCAU Operation" is to "Open ROSS 1" 110. Additionally, the screen 400 also indicates that the "Current HCAU State" is "Operating Secondary," which refers to moving the actuating member of the controller 100 into position to align the control line 11 with the sleeve control line 111. Operational variables shown on this information screen 400 include outlet flow rate 405 in cc/sec, return flow rate 410, time elapsed during the operation 415, and fluid pressure 420. As will be discussed later, the successful alignment of the ports to the inflow device 110 is assured based upon changing conditions in the fluid control system. For example, pressure increases and flow rate decreases in the outlet flow line when the movable member in the controller 100 has moved to its proper position and stopped.

After the control line 11 is aligned with the sleeve control line 111, the system is ready to open the first inflow device 110. However, the next screen 500, shown in FIG. 5, asks the operator to confirm his desire to operate the first inflow device 110. Alternatively, the screen 500 also allows the operator to return the controller to the "Stand-by mode."

Figure 6:
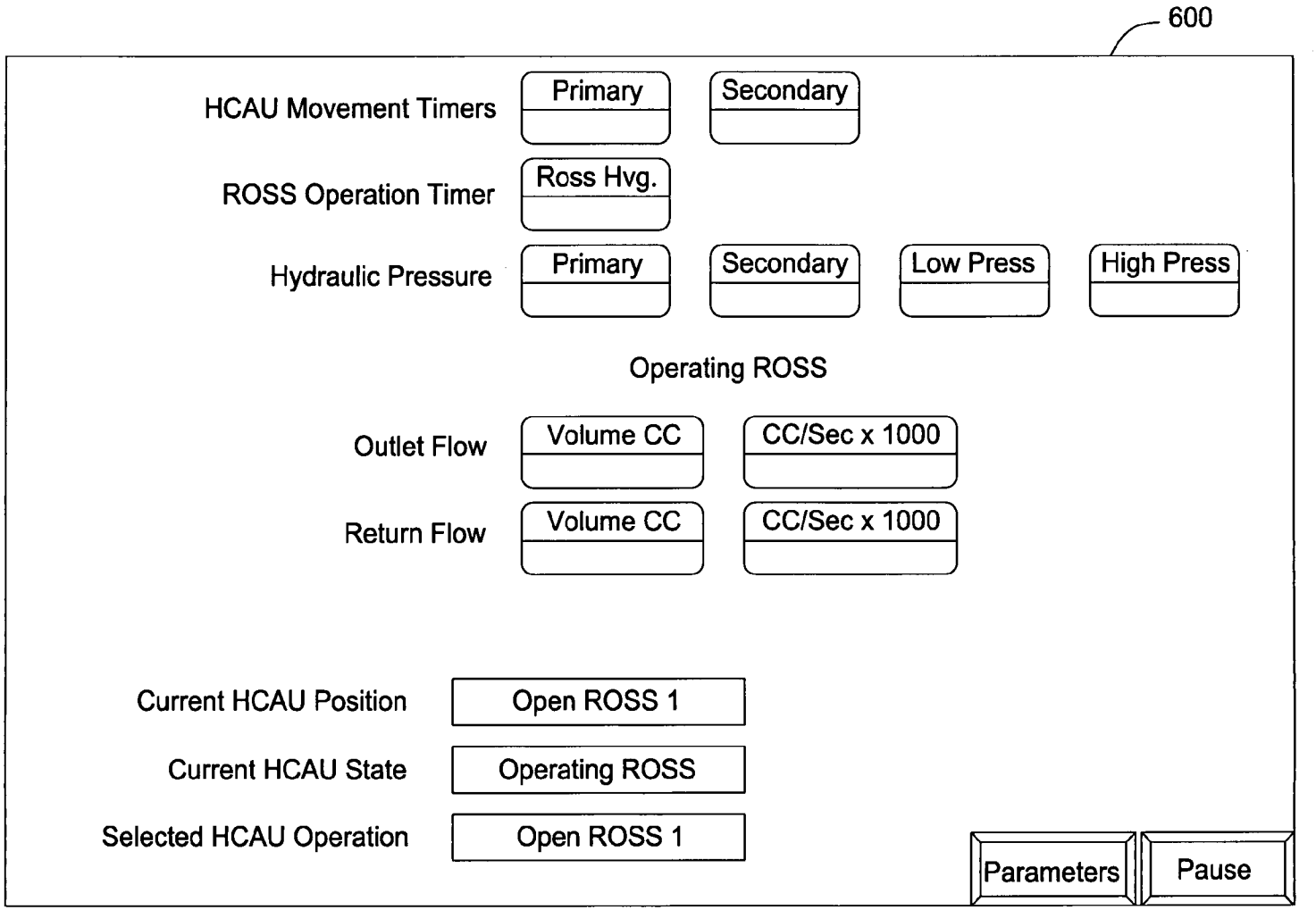

After confirmation by touching the screen 500, the pump at the surface of the well provides fluid at a second, higher pressure. The next screen 600, shown in FIG. 6, is another information screen showing an increase in fluid pressure as the pump provides fluid at the higher pressure to manipulate a sliding sleeve in the first inflow device 110. As indicated on the screen 600, the "Current HCAU State" has changed to "Operating ROSS 1," which refers to the opening of the first inflow device 110. In one embodiment, the pressure needed to operate the controller 100, i.e., move the actuating member, is between 200-1000 psi. Pressure exceeding 1000 psi is then required to operate the first inflow device 110. Real-time display shows the increasing, operating and decreasing pressures and flow rates associated with the operation of the first inflow device 110 between an initial and a secondary position. In this example, the first inflow device 110 is moved from a closed to an open position. Although separately operating the controller and the inflow device is disclosed herein, it is also contemplated that the inflow device may be operated by supplying only one pressure to the controller.

Figure 7:
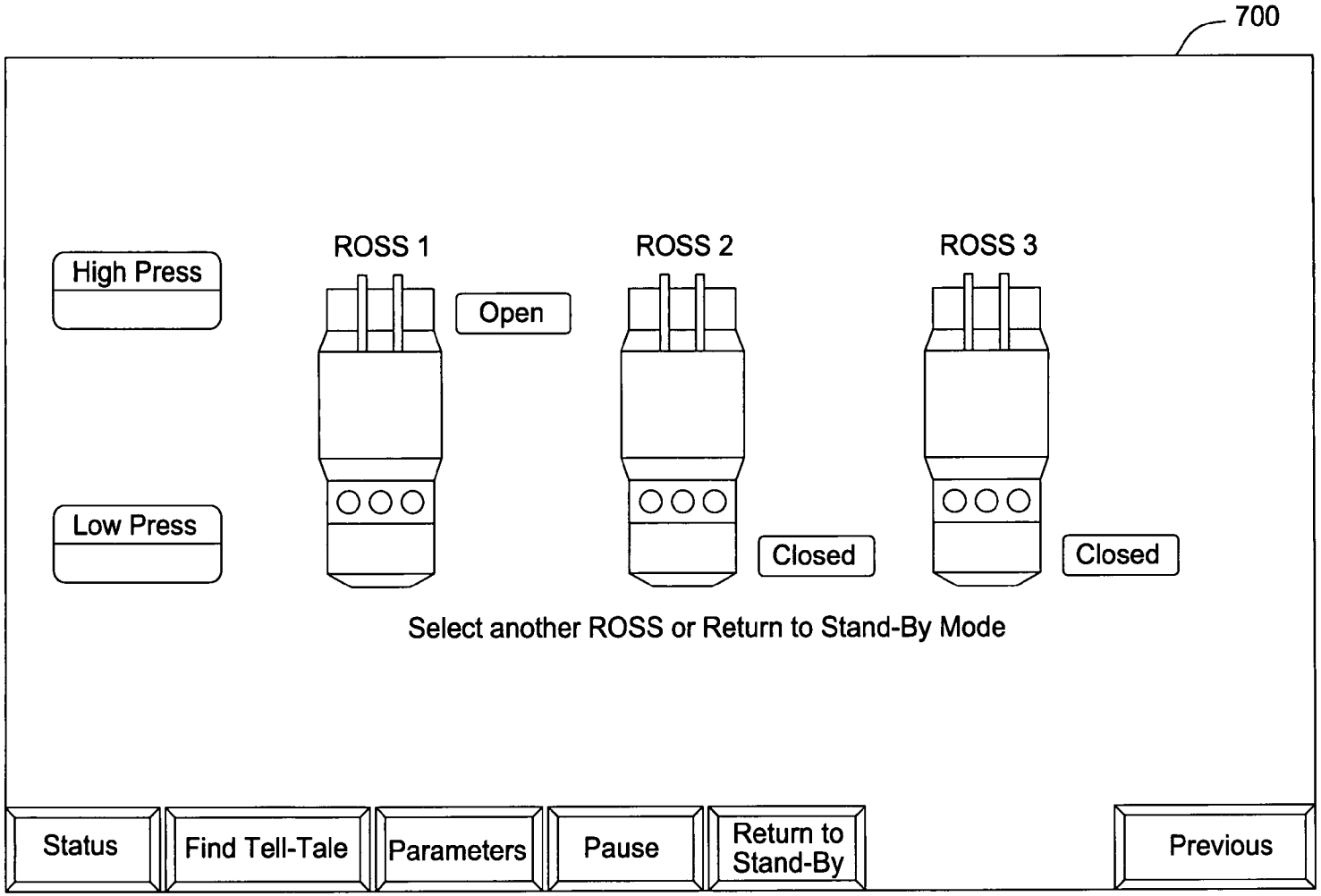

After the first inflow device 110 is opened, another screen 700, shown in FIG. 7, shows that the icon 210 of the first inflow device 110 now indicates that the first inflow device 110 is open. Additionally, the screen 700 also indicates that the system has returned to a standby mode for commencement of another operation that opens or closes inflow devices 110, 120, 130.

Throughout the automated operations described above, the conditions within the fluid power system can be constantly monitored and compared to standards in order to spot malfunctions or operational characteristics that are outside of a preprogrammed value. For example, if the pressure or flow rate of the fluid operating the controller or an inflow device should drop unexpectedly during an operation, the operator can be alerted of the condition via a warning screen. The condition can mean a fluid leak at either a line or a device and action can be quickly taken to address the problem. Similarly, if an operation is not completed during a preprogrammed time limit necessary for that operation, an operator can be alerted of the condition and take appropriate action. These and other warnings are possible based upon the ability to constantly monitor pressure, flow rate and other variables within the automated system.

Figure 8:
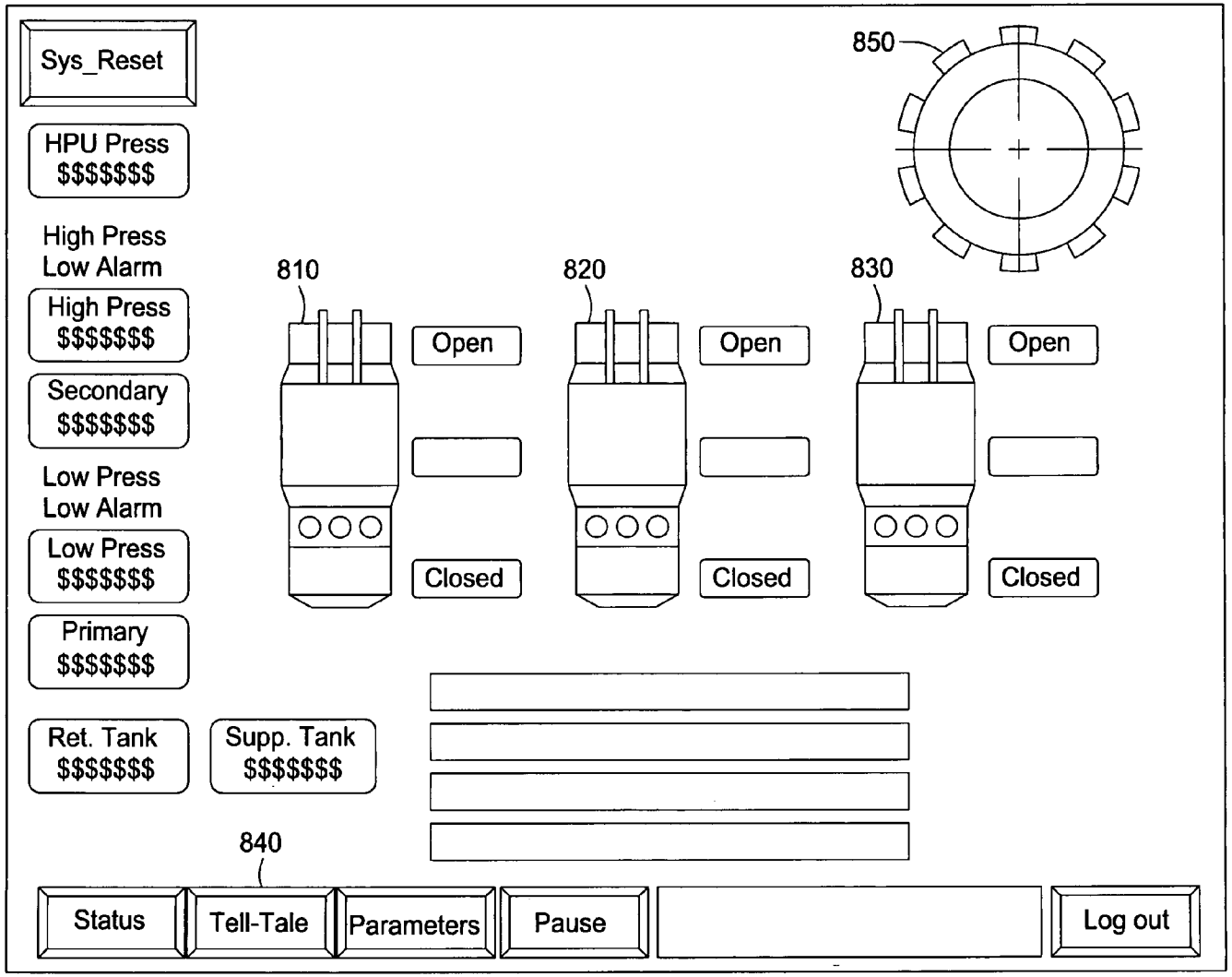
FIG. 8 is another embodiment of a touch screen for operating a control apparatus.

FIG. 8 shows another embodiment of a touch screen 800 according to aspects of the present invention. In this embodiment, the wellbore 5 is provided with three inflow devices 110, 120, 130 located in three different zones of the wellbore 5. Each of the inflow devices 110, 120, 130 is represented by a respective icon 810, 820, 830 on the screen 800. As shown, the screen 800 is in stand-by mode. The inflow device icons 810, 820, 830 may be selected to operate the desired inflow device. If necessary, the controller 100 may be returned to the park position by selecting the tell-tale icon 840. The screen 800 also includes a controller icon 850. The controller icon 850 may be selected to view the status of the controller 100.

Figure 9:
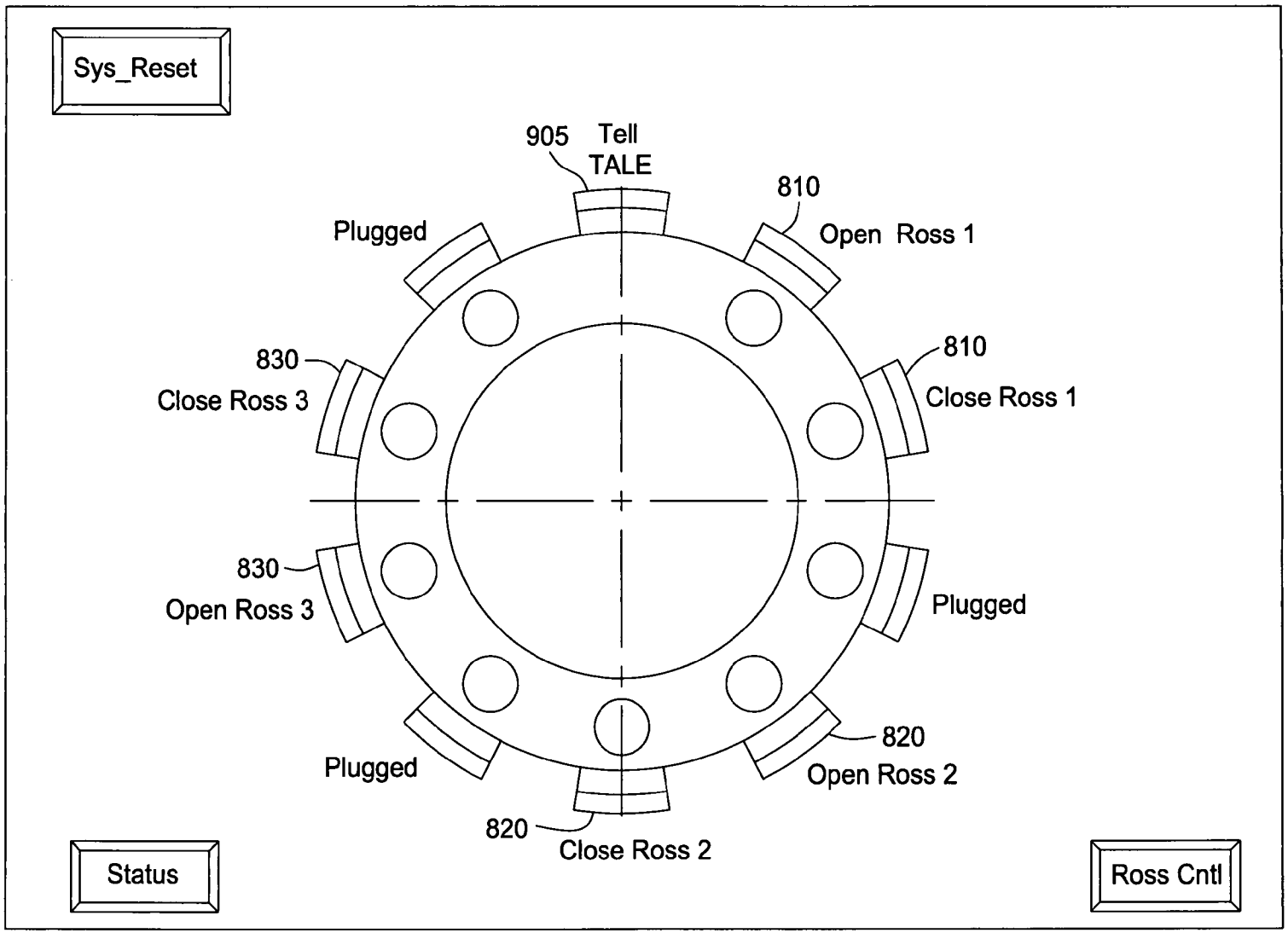
FIGS. 9-11 are touch screens showing the status of the controller.

FIG. 9 represents an information screen 900 that is provided when the controller icon 850 is selected. As shown, the controller 100 is in the park position 905 or the "Tell-Tale" position. The modes of operation of the controller 100 is arranged to represent the position of the actuating member.

Figure 10:
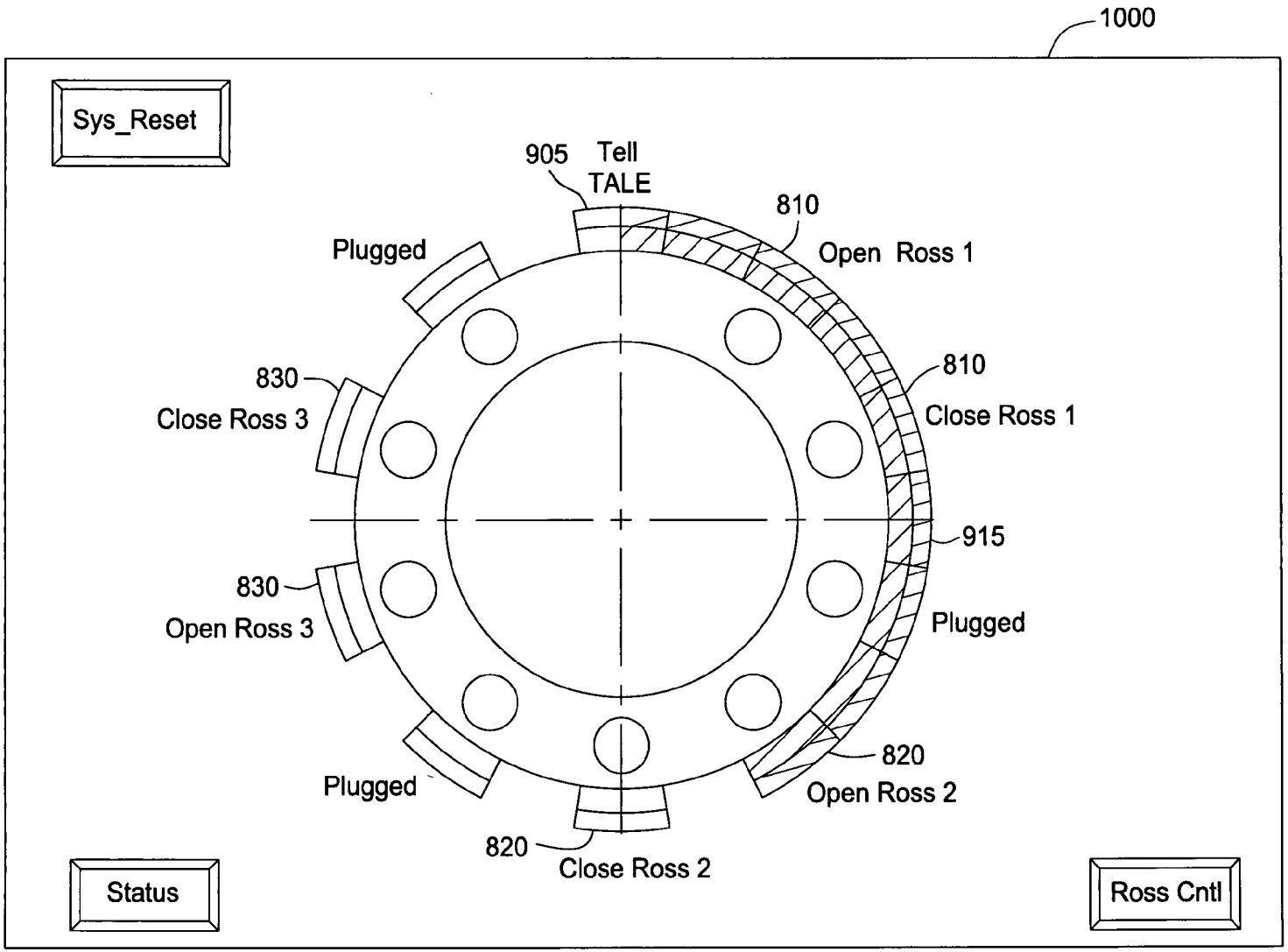

FIG. 10 represents an information screen 1000 that shows the second inflow device 820 as being open. Specifically, the indicator bar 915 extends from the "tell-tale" position to the open position of the second inflow device 820. This represents that the actuating member of the controller 100 has moved to a position that aligns the control 11 with the sleeve control line 121 of the second inflow device 820.

Figure 11:
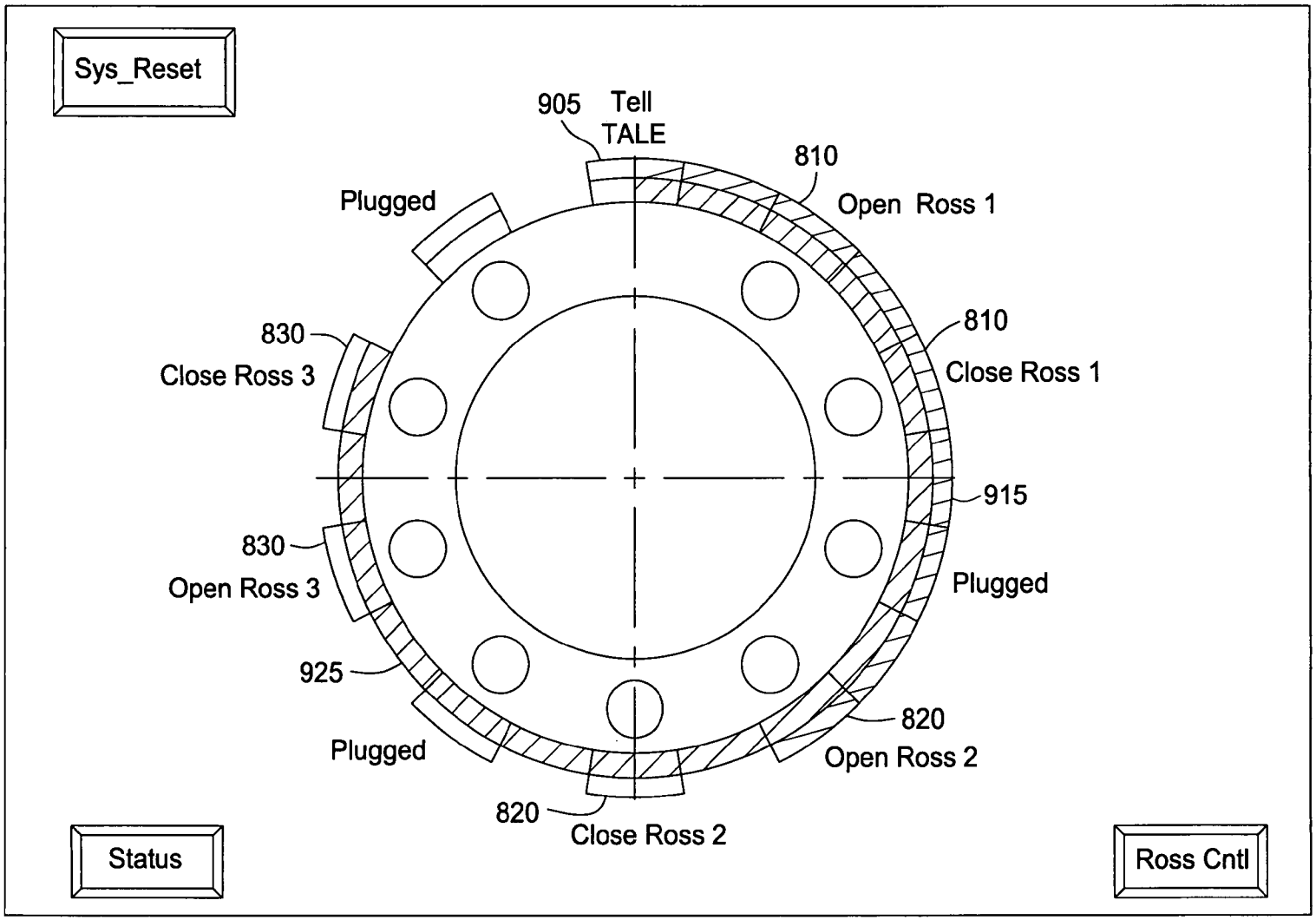

FIG. 11 represents an information screen 1100 that shows the third inflow device 830 is closed. From the open position of the second inflow device 820, an operator may elect to open the closed third inflow device 830. Specifically, the operator may return to the previous touch screen and select the third inflow device icon. Thereafter, the operator may press the controller icon 850 to return to the controller information screen 1100 to view the status of the controller 100. Once selected, a second indicator bar 925 will extend from the previous position to the "close" position of the third inflow device 830. The second indicator bar 925 represents that a second operation was performed, i.e., closing the third inflow device 830. In this manner, the controller 100 may be operated to control the inflow and outflow of the various inflow devices.

It must be noted that aspects of the present invention may be applied to operate one or more inflow devices. The inflow devices may include any suitable inflow or outflow device known to a person of ordinary skill in the art. Additionally, the one or more inflow devices may be adapted to control the flow of fluid in one or more isolated zones in a wellbore. The wellbore may include a deviated or non-deviated wellbore, a single or multilateral wellbore, or any other types of wellbore known to a person of ordinary skill in the art.

While the foregoing is directed to embodiments of the present invention, other and further embodiments of the invention may be devised without departing from the basic scope thereof, and the scope thereof is determined by the claims that follow. For example, while the invention has been described for use with inflow devices having slidable sleeves, it will be understood that the invention can be used with any downhole tool that might benefit from computer control and/or real time monitoring.

We claim:

1. A method of operating a plurality of downhole devices in a wellbore, comprising:

disposing the plurality of downhole devices in the wellbore, each of the plurality of downhole devices having at least an open position and a closed position and in selective communication with a fluid source;

positioning a controller in the wellbore;

generating a signal based upon an operator's interaction with a touch screen;

transmitting the signal to the controller, wherein the signal causes rotation of an actuating member of the controller and the controller places a selected downhole device in fluid communication with the fluid source;

operating the selected downhole device between the open position and the closed position;

displaying a status on the touch screen indicative of the open or closed position for at least one of the plurality of downhole devices; and displaying an image representing the rotation of the actuating member on the touch screen, wherein the image comprises an indicator bar.

2. The method of claim 1, further comprising providing a first fluid pressure to move the selected downhole device between the open position and the closed position.

3. The method of claim 2, wherein the signal comprises a second fluid pressure.

4. The method of claim 3, wherein the first fluid pressure is higher than the second fluid pressure.

5. The method of claim 1, wherein a different downhole device is placed in communication with the fluid source as the actuating member is incrementally rotated.

6. The method of claim 1, wherein a single fluid control line extends between the controller and the fluid source.

7. The method of claim 1, wherein each of the plurality of downhole devices has a fluid control line connected with the controller.

8. The method of claim 7, wherein a single fluid control line extends between the controller and the fluid source.

9. The method of claim 7, further comprising monitoring one or more conditions within the fluid control line of at least one of the plurality of downhole devices.

10. The method of claim 9, wherein the one or more conditions comprise at least one of pressure, time, total flow, and flow rate.

11. The method of claim 9, further comprising notifying the operator if operating the selected downhole device is not completed within an amount of time based on monitoring the one or more conditions.

12. The method of claim 9, further comprising displaying the one or more conditions on the touch screen.

13. The method of claim 1, further comprising removing the controller from fluid communication with the plurality of downhole devices by selecting an icon on the touch screen.

* * * * *